US007748918B2

(12) United States Patent
Harris

(10) Patent No.: US 7,748,918 B2
(45) Date of Patent: Jul. 6, 2010

(54) PRINTER PAPER WASTE REDUCTION METHOD AND COMPUTER PROGRAM PRODUCT

(75) Inventor: Richard H. Harris, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 598 days.

(21) Appl. No.: 11/561,081

(22) Filed: Nov. 17, 2006

(65) Prior Publication Data

US 2008/0118295 A1 May 22, 2008

(51) Int. Cl.
*B65H 26/06* (2006.01)
*B41J 29/48* (2006.01)

(52) U.S. Cl. ..... 400/613; 400/621; 242/563.2

(58) Field of Classification Search ..... 400/613, 400/621, 613.1, 583, 708; 242/563, 563.1, 242/563.2; 271/9.1; *B65H 26/06*
See application file for complete search history.

(56) References Cited

U.S. PATENT DOCUMENTS 4,070,761 A 1/1978 Collins
4,204,180 A 5/1980 Usui et al.
4,494,203 A * 1/1985 Suzuki et al. ..... 700/140
5,820,068 A 10/1998 Hosomi et al.
5,845,057 A * 12/1998 Takeda et al. ..... 358/1.15
6,059,222 A * 5/2000 Yuyama et al. ..... 242/563
6,091,928 A * 7/2000 Fuchisawa ..... 399/384
6,502,784 B1 1/2003 Sato
6,661,979 B2 * 12/2003 Barlow ..... 399/23
2005/0167541 A1 8/2005 Osborne

FOREIGN PATENT DOCUMENTS

JP 57203643 12/1982
JP 58115322 7/1983
JP 2033049 A 2/1990
JP 5016499 A 1/1993
JP 05221102 A * 8/1993

* cited by examiner

*Primary Examiner*—Judy Nguyen
*Assistant Examiner*—Jennifer Simmons
(74) *Attorney, Agent, or Firm*—Cantor Colburn LLP; Jason O. Piche

(57) ABSTRACT

Disclosed herein is a method that relates to paper waste reduction with a point of sale printer. The method comprising, establishing a length of paper available (PA) estimate during loading of paper into a point of sale printer and tracking a length of paper used (PU). The method further comprising, continuously updating the PA by subtracting the PU from the PA, and alerting an operator to replenish paper in the printer in response to the PA being less than a desired length of paper wasted (DPW). Additionally, the method updates the new roll paper available (NRPA) to ensure that the difference between actual paper wasted (APW) and the desired length of paper wasted (DPW) is minimal.

14 Claims, 2 Drawing Sheets

PRINTER PAPER WASTE REDUCTION METHOD AND COMPUTER PROGRAM PRODUCT

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

Many point of sale printers use rolls of paper upon which to print customer receipts. The length of each printed receipt can vary depending upon such things as the number of items listed on the receipt, for example. It is often desirable for merchants, who use such point of sale printers, to receive an indication that the length of paper remaining in the current roll of paper is nearing its end. One common method of such indication is to have a color, such as pink, for example, applied to the paper from a predetermined length from the end of the roll. Such a predetermined length, however, may be inadequate for merchants that typically use long lengths of paper per receipt, and may, therefore, result in running out of paper during the printing of a receipt. For other merchants, however, that typically use less paper per receipt the predetermined length may be longer than they desire. For these merchants the predetermined length may result in wasting paper when, for example, an operator replaces a paper roll, as soon as the pink color is observed, when in fact, several additional full receipts could have been printed prior to replacing the roll.

Accordingly, the art is in need of "paper remaining" alerts that are adjustable and customizable.

BRIEF DESCRIPTION OF THE INVENTION

Disclosed herein is a method that relates to paper waste reduction with a point of sale printer. The method comprising, establishing a length of paper available (PA) estimate during loading of paper into a point of sale printer and tracking a length of paper used (PU). The method further comprising, continuously updating the PA by subtracting the PU from the PA, and alerting an operator to replenish paper in the printer in response to the PA being less than a desired length of paper wasted (DPW).

Further disclosed herein is a computer program product for reducing paper wasted by a point of sale printer in a computer environment. The computer program product comprising a storage medium readable by a processing circuit and storing instructions for execution by the processing circuit for facilitating a method. The method comprising, establishing a length of paper available (PA) estimate during loading of paper into a point of sale printer and tracking a length of paper used (PU). The method further comprising, continuously updating the PA by subtracting the PU from the PA, and alerting an operator to replenish paper in the printer in response to the PA being less than a desired length of paper wasted (DPW).

System and computer program products corresponding to the above-summarized methods are also described and claimed herein.

Additional features and advantages are realized through the techniques of the present invention. Other embodiments and aspects of the invention are described in detail herein and are considered a part of the claimed invention. For a better understanding of the invention with advantages and features, refer to the description and to the drawings.

As a result of the summarized invention, technically we have achieved a solution, which reduces an amount of paper wasted with a point of sale printer through tracking paper usage against an initial amount of paper available and a desired amount of waste paper.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawing in which:

The detailed description explains the preferred embodiments of the invention, together with advantages and features, by way of example with reference to the drawings.

DETAILED DESCRIPTION OF THE INVENTION

A detailed description of embodiments of the disclosed apparatus and method are presented herein by way of exemplification and not limitation with reference to the Figures.

Figure 1:
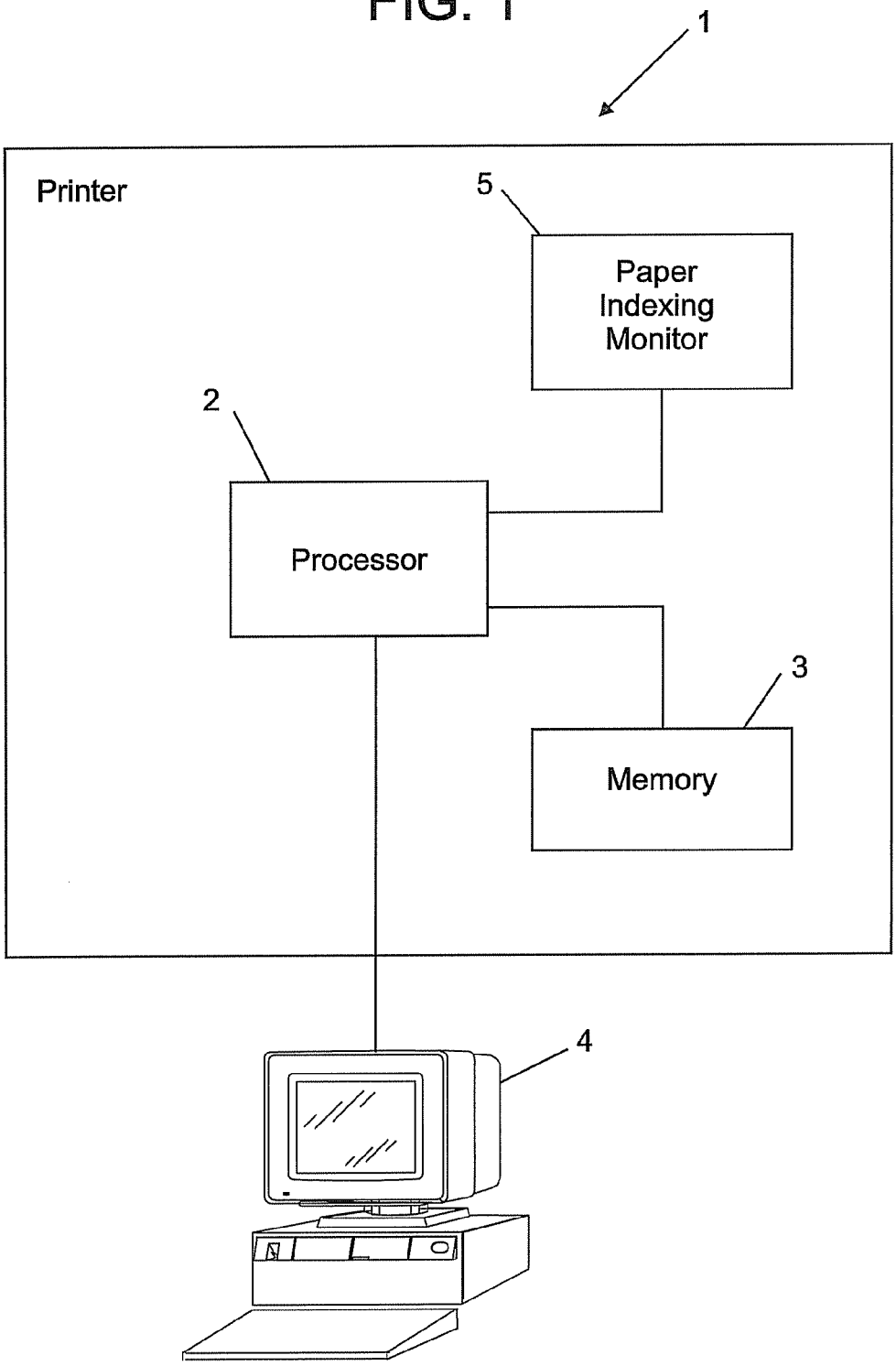
FIG. 1 depicts a point of sale printer for carrying out embodiments of the process disclosed herein.

Referring to FIG. 1, a point of sale printer for carrying out embodiments of the process disclosed herein is shown generally at 1. The printer 1 has a processor 2 capable of executing computer code for carrying out embodiments of the invention. A nonvolatile memory 3 is in communication with the processor 2 and enables the printer 1 to maintain data even when power is not available to the printer 1. An operator interface 4, in bidirectional communication with the processor 2, allows an operator to input data, such as, whether a paper roll being installed is a new roll or a partial roll, a measured value for a diameter of a paper roll being installed, and a length of paper remaining at which the operator would like an alert to be signaled, for example. The operator interface 4 also allows the operator to receive data, such as an alert that it is time to feed out the remaining paper and install a new paper roll, or display a length of paper available (PA) estimate on a screen, for example. It should be noted that the operator interface 4 can be connected directly to the processor 2 or can be connected via a network to the processor 2. The printer 1 also includes a paper indexing monitor 5 in communication with the processor 2 that measures a length of paper used (PU) and feeds the data to the processor 2. An embodiment of a process flow disclosed herein that can be implemented on the printer 1 of FIG. 1 will be described below.

Figure 2:
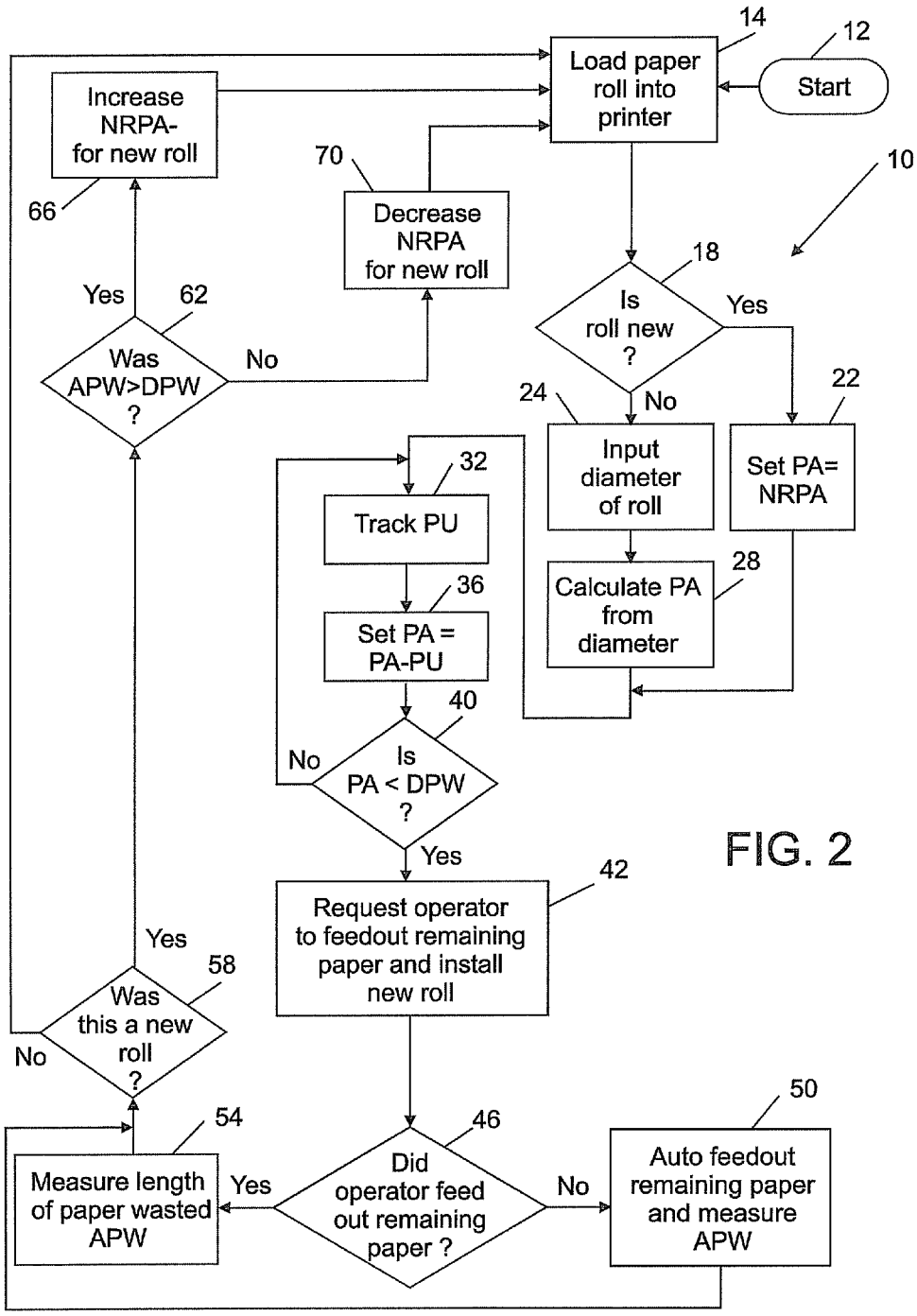
FIG. 2 depicts a process flow that may be implemented by exemplary embodiments to reduce wasted paper at a point of sale printer.

Referring to FIG. 2, a process flow 10 that may be implemented by exemplary embodiments to reduce wasted paper at a point of sale printer 1 will now be described. Block 12 indicates the start of the process. At block 14, a roll of paper is loaded into the printer 1. A determination is made, at block 18, as to whether the roll is a new roll or a partial roll. If the roll is new, then block 22 is performed, and an operator loads the new roll and the printer 1 defaults to a nonvolatile memory stored value for the PA by setting the PA to be equal to the stored new roll length of paper available estimate (NRPA) for a new roll of paper. If the roll being loaded is not new, as determined at block 18, but instead is a partial roll, then block 24 is performed, and a measurement is made of the diameter of the roll and is entered into the printer 1. A gauge for measuring the diameter of such a roll could be included in a printer paper tray, for example, to simplify the measurement process. At block 28, the roll diameter is used to calculate the PA by the processor 2.

At block 32, the printer 1 monitors the PU during operation of the printer 1 and stores the value in nonvolatile memory 3. At block 36, the PA is continuously updated by subtracting the PU from the PA. At block 40, an operator settable desired length of paper wasted (DPW) value is compared to the continuously updated PA. When the PA drops below the DPW, as determined at block 40, then block 42 is performed and the printer 1 alerts the operator that it is time to replenish the paper and requests the operator, via the operator interface 4, to feed out the remaining paper and install a new roll. The alert may take different forms, for example, the printer 1 could add extra space to the end of each receipt printed, and the amount of extra space added to the end of each receipt could increase with each successive receipt printed after the initial alert. Alternatively, the printer 1 could print on the receipt, or display on an operator display screen, a message that it is time to feed out the remaining paper and install a new roll of paper.

Processing then continues at block 46, and a determination is made as to whether or not the operator fed out the remaining paper. If the operator ignored the alert and did not feed out the remaining paper, then block 50 is performed, after a preset length or number or receipts are printed or after the alert, for example, the printer 1 could automatically feed out the remaining paper while measuring the actual length of paper wasted (APW) in the process. If the operator did feed out the remaining paper the printer 1 can measure the APW during the feed out process, then block 54 is performed and the APW is measured. Regardless of whether the operator manually fed out the remaining paper or the printer 1 automatically fed out the remaining paper, once the APW is determined the process continues at block 58 and the printer 1 determines whether the roll just completed was a new roll or not based on the answer from block 18 above.

If the roll just completed was a new roll, then the printer 1 determines, at block 62, if the APW was greater than the DPW. If the APW was greater than the DPW, then block 66 is performed, and the NRPA is increased by an arbitrarily preset value so that the next time a new roll is used the APW will be decreased towards DPW. If, on the other hand, the APW was less than the DPW, then block 70 is performed, and the NRPA is decreased by an arbitrarily preset value so that the next time a new roll is used the APW will be increased toward DPW. Through this process the APW will automatically be adjusted toward the DPW set by the operator via the operator interface 4.

An algorithm, in another alternative embodiment, could automatically determine if the roll is new or if it is a new paper roll with a new length of paper by recording the amount of previous adjustments to NRPA, and if a current proposed adjustment exceeds the mean plus a tolerance, for example plus or minus two standard deviations, of the previous adjustments; the roll is assumed to be either not a new roll or could be new roll that contains a different length of paper. A proposed adjustment that exceeds this tolerance is not made, but a record is maintained of the last ten or so proposed adjustments to establish a new NRPA in case the new supply is being used.

If, however, the roll just completed was not a new roll, as determined at block 58, then no adjustment is made to the NRPA and the printer 1 awaits an operator to load a roll of paper into the printer 1, at block 14, and the process repeats.

Embodiments described above may permit merchants with point of sale printers 1 to decrease the APW by alerting operators to replenish the paper at merchant selectable values of DPW, and to thereby save money by decreasing APW. A continuously updated value of paper remaining could be presented to the operator, via the operator interface 4, at all times or upon request from the operator. Such information could allow merchants to replenish rolls when desired to perhaps avoid paper outages during specifically busy times and thereby improve customer satisfaction. Incorporation of embodiments disclosed herein could be implemented in existing printers 1 through only changes in software and not in changes to hardware.

As described above, embodiments may be in the form of computer-implemented processes and apparatuses for practicing those processes. In exemplary embodiments, the invention is embodied in computer program code. Embodiments include computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. Embodiments include computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. The technical effect of the executable instructions is to reduce an amount of actual paper wasted with a point of sale printer through tracking paper usage against an initial amount of paper available and a desired amount of waste paper and automatically iterating to achieve more accurately the desired paper wasted.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method of reducing waste from a point of sale printer the method comprising:

establishing a length of paper available (PA) estimate during loading of paper into a point of sale printer;

tracking a length of paper used (PU);

continuously updating the PA by subtracting the PU from the PA;

alerting an operator to replenish paper in the printer in response to the PA being less than a desired length of paper wasted (DPW);

measuring an actual length of paper wasted (APW) by measuring the length of paper fed out of the printer after the alert was signaled; and adjusting a new roll length of paper available (NRPA) estimate for a new roll of paper based on the difference between the APW and the DPW on a previous new roll of paper used.

2. The method of claim 1, further comprising:

requesting an operator to acknowledge a request to replace the paper roll.

3. The method of claim 1, further comprising:

calculating an amount to adjust the NRPA based on a comparison between the APW, the DPW and the preceding adjustment made to the NRPA.

4. The method of claim 1, further comprising:

increasing the NRPA for a new roll of paper based on the APW exceeding the DPW on a previous roll of paper used.

5. The method of claim 1, further comprising:

decreasing the NRPA for a new roll of paper based on the APW being less than the DPW on a previous roll of paper used.

6. The method of claim 1, further comprising:

calculating the PA from a measured diameter of a paper roll.

7. The method of claim 1, further comprising:

setting the PA to be equal to a NRPA stored in memory.

8. The method of claim 1, wherein the alerting includes adding length to paper output from the printer.

9. The method of claim 1, wherein the alerting includes printing a low paper alert message on a printout.

10. The method of claim 1, wherein the alerting includes displaying a low paper alert message on a display.

11. The method of claim 1, further comprising:

automatically feeding out all paper remaining in the printer in response to an operator not manually feeding out the paper remaining in the printer after a preset length of paper is used once the operator is alerted to replenish the paper.

12. The method of claim 1, further comprising:

displaying the PA.

13. A method of reducing paper wasted with a point of sale printer, the method comprising:

receiving a desired paper waste value;

setting a length of paper available for a new roll of paper installed in the printer to a stored new roll of paper available estimate;

monitoring paper used by the printer;

subtracting the paper used from the paper available estimate;

comparing the subtracted result to the desired paper waste value;

signaling an alert in response to the subtracted result being less than the desired paper waste value;

measuring an actual amount of paper wasted by measuring the length of paper fed out of the printer after the alert was signaled; and adjusting the stored new roll of paper available estimate based on an actual amount of paper wasted as compared to the desired amount of paper wasted for a previously used new roll of paper.

14. A computer program product for reducing paper wasted by a point of sale printer in a computer environment, the computer program product comprising a storage medium readable by a processing circuit and storing instructions for execution by the processing circuit for facilitating a method comprising:

establishing a length of paper available (PA) estimate during loading of paper into a point of sale printer;

tracking a length of paper used (PU);

continuously updating the PA by subtracting the PU from the PA; and alerting an operator to replenish paper in the printer in response to the PA being less than a desired length of paper wasted (DPW);

measuring an actual length of paper wasted (APW) by measuring the length of paper fed out of the printer after the alert was signaled; and adjusting a new roll length of paper available (NRPA) estimate for a new roll of paper based on the difference between the APW and the DPW on a previous new roll of paper used.

* * * * *